US010086426B2

(12) United States Patent
Spitzer et al.

(10) Patent No.: US 10,086,426 B2
(45) Date of Patent: Oct. 2, 2018

(54) METHOD FOR PRODUCING A HOT STRIP BY MEANS OF STRIP CASTING WITH MATERIAL PROPERTIES ADJUSTABLE ACROSS THE STRIP CROSS-SECTION

(75) Inventors: Karl-Heinz Spitzer, Clausthal (DE); Volker Flaxa, Salzgitter (DE); Joachim Kroos, Meine (DE); Hellfried Eichholz, Ilsede (DE); Markus Schäperkötter, Braunschweig (DE); Rune Schmidt-Jürgensen, Hannover (DE)

(73) Assignee: Salzgitter Flachstahl GmbH, Salzgitter (DE)

( * ) Notice: Subject to any disclaimer, the term of this patent is extended or adjusted under 35 U.S.C. 154(b) by 0 days.

(21) Appl. No.: 13/391,166

(22) PCT Filed: Jul. 14, 2010

(86) PCT No.: PCT/DE2010/000826
§ 371 (c)(1),
(2), (4) Date: Apr. 25, 2012

(87) PCT Pub. No.: WO2011/020451
PCT Pub. Date: Feb. 24, 2011

(65) Prior Publication Data

US 2012/0279677 A1 Nov. 8, 2012

(30) Foreign Application Priority Data

Aug. 21, 2009 (DE) ..... 10 2009 038 974

(51) Int. Cl.
*B22D 11/00* (2006.01)
*B22D 11/06* (2006.01)
*B22D 25/02* (2006.01)

(52) U.S. Cl.
CPC ..... *B22D 11/0631* (2013.01)

(58) Field of Classification Search
CPC ..... B22D 11/00; B22D 11/0631; B22D 25/02
(Continued)

(56) References Cited

U.S. PATENT DOCUMENTS 4,224,356 A * 9/1980 Singer ..... B22D 23/003 164/46
4,523,625 A * 6/1985 Ast ..... 164/461
(Continued)

FOREIGN PATENT DOCUMENTS

DE 3424061 A1 1/1985
DE 19918581 A1 11/1999
(Continued)

OTHER PUBLICATIONS

Spitzer, et al., U.S. Pat. No. 8,047,263, Nov. 1, 2011, 2010-0000703, Jan. 7, 2010.
(Continued)

*Primary Examiner* — Kevin P Kerns
(74) *Attorney, Agent, or Firm* — Henry M. Feiereisen LLC

(57) ABSTRACT

In a method for producing a hot strip of steel with material properties that are adjustable over the strip cross-section, a steel melt is fed onto a revolving casting belt of a horizontal strip casting facility and solidifies to form a pre-strip having a thickness between 6 and 20 mm, and the pre-strip is subjected to a hot rolling process after complete solidification. A gas jet or plasma jet composed of metallic and/or non-metallic elements that affect the material properties of the hot strip influences the steel melt that is still liquid and/or just about to start to solidify. The concentration of the elements introduced into the melt by the gas jet or plasma jet and diffusing into the melt is adjusted across the strip thickness and strip width by changing the influencing kinetic
(Continued)

energy of the gas jet or plasma jet, the partial gas pressure and/or the applied temperature.

11 Claims, 1 Drawing Sheet

(58) Field of Classification Search
USPC ..... 164/463, 473, 475, 479, 423, 429
See application file for complete search history.

(56) References Cited

U.S. PATENT DOCUMENTS

| | | | | |
|---|---|---|---|---|
| 4,588,021 | A * | 5/1986 | Bergeron et al. | 164/432 |
| 6,110,296 | A | 8/2000 | Zaranek | |
| 8,047,263 | B2 * | 11/2011 | Spitzer et al. | 164/442 |
| 2005/0172899 | A1 * | 8/2005 | Fukuda et al. | 118/718 |
| 2009/0173412 | A1 | 7/2009 | Schoettler et al. | |
| 2009/0266503 | A1 | 10/2009 | Spitzer et al. | |
| 2011/0024006 | A1 | 2/2011 | Schoettler et al. | |

FOREIGN PATENT DOCUMENTS

| | | | | | |
|---|---|---|---|---|---|
| DE | 10124594 | A1 | | 12/2002 | |
| JP | 58-179542 | A | * | 10/1983 | B22D 11/06 |
| JP | 58179542 | A | | 10/1983 | |
| JP | 1-306052 | A | * | 12/1989 | B22D 11/06 |
| WO | WO 2006/066552 | A1 | * | 6/2006 | B22D 11/06 |

OTHER PUBLICATIONS

Spitzer, et al., U.S. Pat. No. 8,069,904, Dec. 6, 2011, 2010-0059196, Mar. 11, 2010.

Kroos, et al., U.S. Pat. No. 7,806,165, Oct. 5, 2010, 2007-0289717 A1, Dec. 20, 2007.

Spitzer, K-H. et al: "Direct Strip Casting- . . . ", in Steel Research, vol. 74, No. 11/12, Jan. 1, 2003; pp. 724-731.

* cited by examiner

METHOD FOR PRODUCING A HOT STRIP BY MEANS OF STRIP CASTING WITH MATERIAL PROPERTIES ADJUSTABLE ACROSS THE STRIP CROSS-SECTION

CROSS-REFERENCES TO RELATED APPLICATIONS

This application is the U.S. National Stage of International Application No. PCT/DE2010/000826, filed Jul. 14, 2010, which designated the United States and has been published as International Publication No. WO 2011/020451 and which claims the priority of German Patent Application, Serial No. 10 2009 038 974.1, filed Aug. 21, 2009, pursuant to 35 U.S.C. 119(a)-(d).

BACKGROUND OF THE INVENTION

The invention relates to a method for producing a hot strip by means of strip casting with material properties adjustable across the strip cross-section.

The hotly contested automobile market forces manufacturer to continuously look for solutions to reduce the fleet consumption while maintaining highest possible comfort and protection of occupant. Weight saving of all vehicle components plays hereby a crucial role as does a performance of the individual components at high static and dynamic loads during operation and in the event of a crash in order to promote the passive safety of the passengers.

Suppliers of raw material attempt to meet these demands by providing load-optimized metal sheets or strips of steel (e.g. tailor welded or tailor rolled blanks) which are optimized with respect to sheet thickness or made from materials of different strength to suit the load to be expected.

Such metal sheets or strip of steel have to meet comparably stringent requirements with respect to strength, stretch capability, toughness, energy absorption, and workability, for example through cold forming, welding and/or surface treatment.

The manufacture of load-optimized metal sheets of steel is disadvantageous because the welded sheet metal blanks require complex cutting and joining processes and exhibit sharp property gradients at the material transition.

DE 101 24 594 A1 discloses for example a method for producing a composite strip of steel. A directly cast ferritic core strip is hereby plated in accordance with the double roller process with an austenitic or high-alloyed ferritic plating strip.

The sharp jump of the properties of the composite material caused by plating is hereby disadvantageous because it complicates to suit the properties across the strip thickness to the requirement at hand. Furthermore, the properties cannot be varied across the strip width.

A method for producing hot strips of lightweight structural steel using a horizontal strip casting facility is known e.g. from the journal "steel research" 74 (2003), No. 11/12, page 724-731. Melt is fed in this method from a feed vessel via a casting channel onto a circulating casting belt of a horizontal strip casting facility. The fed melt solidifies when undergoing intense cooling to form a pre-strip with a thickness in the range between 6-20 mm. After thorough solidification, the pre-strip undergoes a hot rolling process.

This method is capable to produce in an ideal manner, e.g. lightweight structural steel having a high content of manganese that could otherwise be produced only in a difficult way when using conventional methods, like continuous casting.

The publication DE 199 18 581 A1 discloses the casting of thin strips of carbon steels, whereby the strip strength is enhanced by subjecting the strip to a carburizing or nitriding treatment. This can occur directly after casting or after casting followed by cold rolling and annealing.

Heretofore, this known strip casting method is however not adequate to produce hot strips of steel which have load-optimized material properties across the strip cross-section.

SUMMARY OF THE INVENTION

It is an object of the invention to provide a method for producing composite materials with a steel matrix using horizontal strip casting and allowing variable adjustment of the required material properties across the strip cross-section.

This object is solved in accordance with the invention by a method for producing a hot strip made of steel and having material properties that can be adjustable across the strip cross-section, wherein a steel melt is fed onto a revolving casting belt of a horizontal strip casting facility by means of a casting channel and solidifies to form a pre-strip having a thickness between 6 and 20 mm, and the pre-strip is subjected to a hot rolling process after complete solidification, wherein a gas jet or plasma jet composed of metallic and/or non-metallic elements which influence the material properties of the hot strip acts on the steel melt which is still liquid and/or just about to start to solidify, wherein the concentration of the elements introduced by the gas jet or plasma jet into the melt and diffusing there is adjusted across the strip thickness and strip width by changing the impacting kinetic energy of the gas jet or plasma jet, the partial gas pressure and/or the applied temperature Advantageous refinements and an apparatus for producing hot strips are the subject matter of sub-claims.

The described method thus does not seek the introduction of gas bubbles into the matrix but the geometric penetration of the gas jet or plasma jet into the melt bath, which is still liquid and/or just about to start to solidify, causes the molecules or particles transported with the gas or plasma to diffuse into the matrix and thereby influence the material properties.

The method according to the invention is basically suitable for the production of hot strips made from most different metallic materials, especially also for high-alloyed lightweight structural steel.

The method according to the invention advantageously provides for the first time the possibility to produce a finished structural part that meets the specific requirements with respect to material properties by allowing a targeted adjustment across the strip thickness as well as across the strip width.

Alloying components which are gaseous, vaporous or assume the state of the plasma are hereby applied onto the matrix of the steel melt which is still liquid and/or just about to start to solidify for the purpose of corresponding deposition process, with the metallic and/or non-metallic elements contained in the gas or plasma vapor diffusing into the matrix.

Alloying elements may also for example be involved here which have limited solubility in iron at typical liquidus temperatures and which cannot be introduced into the matrix or only to a limited degree when using conventional production methods because of material incompatibility, metallurgical segregation, evaporation etc.

Moreover, solid particles, such as e.g. metal or ceramics particles, can be added to the gas jet (aerosols) so that the method according to the invention allows for implementation of completely novel composite or gradient materials with respectively new properties.

When using a gas jet, the gas may be made e.g. of $N_2$, CO, $CO_2$, inert or reducing gases and may impact the melt bath surface cold or pre-heated depending on the requirements.

By adjusting the kinetic energy of the partial gas pressure and optionally the temperature, the gas molecules diffuse from the strip surface in strip width direction in a manner which adjusts a gradient in a desired way and accordingly influences the material properties of the solidified strip. When using $N_2$, CO, $CO_2$, a hardness gradient can be deliberately adjusted across the strip thickness for example.

When using a hot plasma jet, the plasma may be made e.g. also of metal vapors so as to be able to introduce any alloying elements into the material in order to deliberately influence the material properties. This may involve, e.g., Cr to improve corrosion properties, or Si to enhance the soft-magnetic properties or the scaling resistance, or copper to reduce the electric resistance in selected material regions.

In principle, there are no limits imposed on the selection of the non-metallic or metallic elements in order to create a hot strip which is optimized with respect to the required properties for a composite or gradient material.

Advantageously, the application of the gas jet or plasma jet can be implemented across the entire width of the casting belt or is variably adjustable.

The casting belt is hereby acted upon only at certain required regions across the width thereof or across the entire width thereof, using a respective number of feed points, e.g. gas nozzles or plasma burners.

A variable gas jet or plasma jet application can advantageously also be used to adjust the material properties over the length of the cast belt. This can, for example, be realized by switching the normally stationary gas jet or plasma jet application on and off during the belt transport while solidification occurs or controlling its intensity infinitely variable or incrementally.

The impact of the strip by a gas jet or plasma jet can not only be used for introducing elements into the strip material but the energy contained in the plasma jet can also be advantageously used for example to subject the elements introduced by a gas jet to a targeted heat treatment in order to reinforce diffusion for example. Thus, the use of the plasma jet enables targeted introduction of e.g. "tracks" into the strip with modified material properties.

In summary, the invention attains the following advantages:

Adjustment of required surface properties through expensive alloying elements only in the surface—economical material structure through cost-beneficial core material.

Targeted influence can be applied on:

wear/abrasion/tribology
scaling resistance
corrosion protection
coating capability
bonding capability
electric properties
weldability (resistance spot weldability)
thermal properties (bimetal)
optical properties (appearance).

Realization of combinations of different surface and material core properties.

Use of various solidification mechanisms in certain sections, such as e.g. solid solution strengthening and precipitation for producing strength gradients or locally specific deformation or crash properties.

BRIEF DESCRIPTION OF THE DRAWING

The method according to the invention will be described in greater detail with reference to a drawing, in which.

DETAILED DESCRIPTION OF PREFERRED EMBODIMENTS

Figure 1:
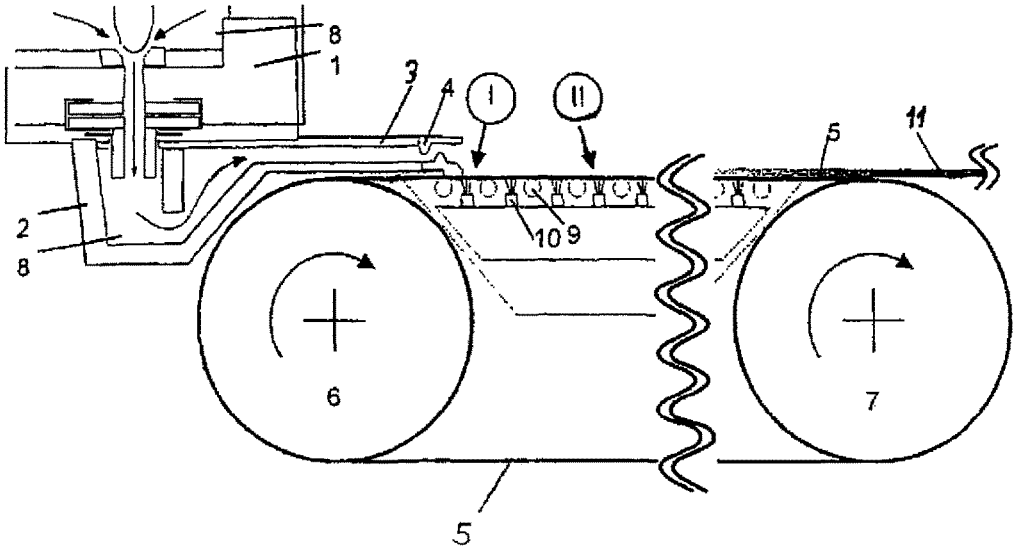
FIG. 1 shows the schematic illustration of a horizontal strip casting facility with impact points for the gas jet or plasma jets for influencing the material properties.

FIG. 1 shows by way of the schematic illustration of a horizontal strip casting facility the possible impact points for the gas jet or plasma jets for targeted influencing the material properties of the steel strip.

A melting vessel 1 is shown from which the liquid steel melt 8 is fed via a feed vessel 2 to a casting channel 3 so that the melt 8 is deposited by a casting nozzle 4 onto a casting belt 5 revolving about a leading deflection roller 6 and a trailing deflection roller 7. The casting belt 5 is supported between the deflection rollers 6 and 7 by support rollers 9 between which cooling nozzles 10 are arranged for cooling the belt. The depicted rotation arrows at the deflection rollers 6 and 7 designate the transport direction of the solidified casting strand 11.

The possible impact points of the gas jet or plasma jet upon the casting strand are labeled with I and II.

At the impact point I, the melt is still liquid even on the strand surface. As a result of the penetration of the transport medium (e.g. by means of the gas jet or plasma jet) into the still liquid melt bath, the melt is inoculated with gaseous/vaporous metallic and/or non-metallic elements and thoroughly mixed in the melt in a controlled manner as a result of the flows generated by pressure applied by the transport medium upon the melt. The thus attained greater surface and creation of new surfaces leads to an increase in particle amounts that can be diffused in.

Using a downstream electromagnetic transverse agitator in casting direction enables an additional thorough mixing through dispersing the already diffused particles and the increase of diffused amount as a result of the creation of new surfaces.

In the area of the impact point II, the surface of the casting strand has already started to solidify. The porously kept surface allows diffusion of atoms, which are separated at this spot from the transport medium (e.g. gases or vapors), from the surface into the solid material.

Impact of the strip by the gas jet or plasma jets may take place either at one of the two impact points or jointly on both in a time-staggered or simultaneous manner.

Through additional variable impact across strip width and strip length, a wide variety of requirements with respect to required material properties can be realized. Thus, the material properties and the later component properties in the strip can virtually be adjusted at precise locations.

Figure 2:
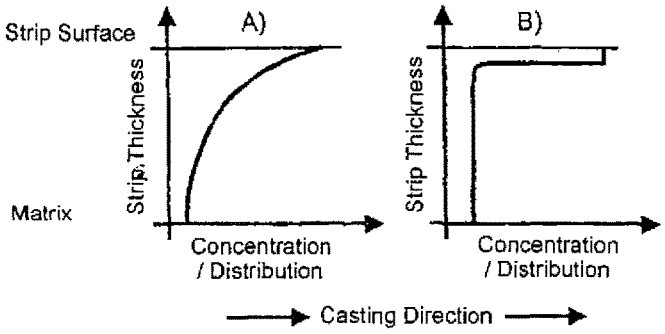
FIG. 2 shows adjustable concentrations or element distributions across the sheet thickness.

The described application positions allow adjustment of the concentrations and distributions across the strip width as illustrated in FIG. 2:

Application Position I→Distribution A):

Gradient materials with steadily unilateral surface gradient. This gradient established by the diffusion can be adjusted by the kinetic energy of the gas jet or plasma jet, the partial gas pressure as the applied temperature (diffusion velocity in temperature-dependent).

Application Position II→Distribution B):

Composite materials with unilateral sudden change in distribution on the outside.

What is claimed is:

1. A method for producing a hot strip of steel, comprising:

feeding a steel melt onto a revolving casting belt of a horizontal strip casting facility;

directing a plasma jet composed of metallic and/or non-metallic elements upon the steel melt while the steel melt is still liquid and/or just about to start to solidify;

adjusting a kinetic energy of the plasma jet to thereby change a concentration of the metallic and/or non-metallic elements being introduced into the steel melt by the plasma jet so as to influence a material property of the steel melt across a thickness and width of the steel melt;

allowing the steel melt to fully solidify to form a pre-strip; and subjecting the pre-strip to a hot rolling process after complete solidification.

2. The method of claim 1, further comprising adding solid particles to the plasma jet.

3. The method of claim 1, wherein the material properties are adjusted symmetrically or asymmetrically across the width of the steel melt.

4. The method of claim 1, wherein the material properties are additionally adjusted in a variable manner across a cast length of the steel melt.

5. The method of claim 1, wherein a targeted impact on still liquid marginal zones of the steel melt with the plasma jet affects a shape of edges of the steel melt during the course of solidification.

6. The method of claim 1, wherein the pre-strip has a thickness between 6 and 20 mm.

7. A method for producing a hot strip of steel, comprising:

feeding a steel melt onto a revolving casting belt of a horizontal strip casting facility;

directing a gas jet composed of metallic and/or non-metallic elements upon the steel melt while the steel melt is still liquid and/or just about to start to solidify;

adjusting a kinetic energy of the gas jet to thereby change a concentration of the metallic and/or non-metallic elements being introduced into the steel melt by the gas jet so as to influence a material property of the steel melt across a thickness and width of the steel melt;

allowing the steel melt to fully solidify to form a pre-strip; and subjecting the pre-strip to a hot rolling process after complete solidification.

8. The method of claim 7, wherein the gas jet is composed of a gas which is inert and/or reducing.

9. The method of claim 7, wherein the gas jet is composed of a mixed gas made of an inert gas as carrier and a reducing gas.

10. The method of claim 7, wherein the gas jet is composed of a gas which is cold or preheated.

11. The method of claim 7, wherein the pre-strip has a thickness between 6 and 20 mm.

* * * * *